US008894384B1

(12) United States Patent
Konrad

(10) Patent No.: US 8,894,384 B1
(45) Date of Patent: Nov. 25, 2014

(54) MULTI-PISTON MOTOR/PUMP

(71) Applicant: George Konrad, Glendale, AZ (US)

(72) Inventor: George Konrad, Glendale, AZ (US)

( * ) Notice: Subject to any disclaimer, the term of this patent is extended or adjusted under 35 U.S.C. 154(b) by 0 days.

(21) Appl. No.: 14/271,661

(22) Filed: May 7, 2014

Related U.S. Application Data

(60) Provisional application No. 61/909,678, filed on Nov. 27, 2013.

(51) Int. Cl.

| | |
|---|---|
| ***F04B 1/18*** | (2006.01) |
| ***F04B 1/04*** | (2006.01) |
| ***F04B 27/10*** | (2006.01) |
| ***F01B 1/06*** | (2006.01) |
| ***F01B 13/06*** | (2006.01) |

(52) U.S. Cl.
CPC ..... *F01B 1/062* (2013.01)
USPC ..... 417/273; 91/498; 91/493; 91/491

(58) Field of Classification Search
CPC .... F03C 1/0444; F03C 1/0438; F03C 1/0415; F03C 1/04; F03C 1/0406; F03C 1/0435; F04B 1/0456; F04B 1/0452; F04B 27/04; F04B 27/0451; F04B 27/0456; F04B 27/0465; F04B 39/012; F04B 39/1033
USPC ..... 91/493, 498, 12.1, 72; 417/273, 512, 417/513
See application file for complete search history.

(56) References Cited

U.S. PATENT DOCUMENTS

| | | | | | |
|---|---|---|---|---|---|
| 409,457 | A | * | 8/1889 | Dennis | 91/180 |
| 2,435,611 | A | * | 2/1948 | Sejarto | 91/6.5 |
| 2,652,035 | A | * | 9/1953 | Bayer | 91/476 |
| 2,729,165 | A | * | 1/1956 | Kremer | 91/496 |
| 3,090,363 | A | * | 5/1963 | Stuver | 91/12 |
| 3,168,006 | A | * | 2/1965 | Bennett | 91/490 |
| 3,306,171 | A | * | 2/1967 | Gordon | 91/498 |
| 3,418,937 | A | | 12/1968 | Cardillo | |
| 3,730,054 | A | * | 5/1973 | Dickinson | 91/491 |
| 3,780,624 | A | * | 12/1973 | Webb | 91/491 |
| 3,981,229 | A | * | 9/1976 | Breisch et al. | 92/72 |
| 4,030,458 | A | | 6/1977 | Lamm | |
| 4,106,391 | A | * | 8/1978 | Wheeler | 91/481 |
| 4,170,167 | A | * | 10/1979 | Breisch | 91/491 |
| 4,221,553 | A | | 9/1980 | Miles | |
| 4,829,879 | A | * | 5/1989 | Santa | 91/493 |
| 5,049,039 | A | * | 9/1991 | Knoth et al. | 417/273 |
| 5,636,599 | A | | 6/1997 | Russell | |
| 5,671,702 | A | * | 9/1997 | Lindblad | 123/44 D |
| 5,865,087 | A | * | 2/1999 | Olson | 91/497 |
| 6,205,960 | B1 | * | 3/2001 | Vallejos | 123/44 R |
| 6,230,670 | B1 | | 5/2001 | Russell | |

(Continued)

*Primary Examiner* — Alexander Comley
(74) *Attorney, Agent, or Firm* — Cahill Glazer PLC

(57) ABSTRACT

A multi-piston motor/pump is disclosed particularly useful for air motor applications incorporating a cylinder block having a plurality of radially extending pistons and cylinders. Each cylinder is provided with a bronze insert at the top of the cylinder having an intake and exhaust port therein. Rotary valves are mounted on an output shaft and include axial flanges having openings therein that align with the input or exhaust openings in each cylinder. As the rotary valves rotate, the openings therein sequentially align with the input/exhaust ports provided in the bronze inserts such that air or fluid entering each cylinder enters axially of the cylinder. A center mounting plate is secured to the cylinder block and separates the input ports from the exhaust ports to enable fluid flow into the input ports and exhaust from the exhaust ports while isolating each port from the adjacent port in each cylinder.

8 Claims, 10 Drawing Sheets

(56) References Cited

U.S. PATENT DOCUMENTS

| | | | | |
|---|---|---|---|---|
| 6,655,927 | B2 | 12/2003 | Herrmann et al. | |
| 6,840,151 | B1 * | 1/2005 | Barker et al. | 91/485 |
| 7,503,291 | B2 * | 3/2009 | Gamble et al. | 123/53.6 |
| 8,052,401 | B2 * | 11/2011 | Kovach et al. | 417/273 |
| 8,113,165 | B2 * | 2/2012 | Russell | 123/149 A |
| 2005/0025633 | A1 * | 2/2005 | Ichikawa et al. | 417/273 |
| 2005/0092171 | A1 * | 5/2005 | Shu | 92/72 |
| 2009/0188466 | A1 * | 7/2009 | Wiens | 123/244 |

* cited by examiner

MULTI-PISTON MOTOR/PUMP

RELATED APPLICATIONS

This application is related to and claims priority to a provisional application entitled "AIR MOTOR/PUMP" filed Nov. 27, 2013, and assigned Ser. No. 61/909,678.

FIELD OF THE INVENTION

The present invention relates to multi-piston motors and particularly to air pumps and air motors.

BACKGROUND OF THE INVENTION

Many industries utilize pressurized air as a source of primary energy to drive equipment in factories and mines and the like. The efficient utilization of this pressurized air to convert the stored energy of the pressurized air to the kinetic energy of a rotating drive shaft permits the implementation of energy utilization complying with the requirements of many work locations. Mines, for example, frequently operate on pressurized air to drive equipment. The present invention provides an efficient utilization of the pressurized air to convert the potential energy of the pressurized air into the kinetic energy of a rotating shaft for driving equipment. Air pumps have innumerable utilization in most industries for the generation of compressed air for its many uses throughout industry.

The present invention is directed to the efficient conversion of energy in the form of compressed air to rotary kinetic energy through a rotating shaft and is directed to the inverse wherein energy is supplied to the rotating shaft (such as by an electric motor) to compress air for utilization elsewhere. The present air motor/pump provides a unique system for conveying air through the motor/pump with a minimum of loss thus resulting in increased efficiency. The motor/pump of the present invention may also be used with fluids other than air.

SUMMARY OF THE INVENTION

The efficiency of a multi-piston motor/pump is greatly increased through the utilization of a rotary valve system that permits the intake and exhaust of fluids such as air into and out of radially disposed cylinders. The system of the present invention includes a plurality of radially extending cylinders having pistons mounted for reciprocating movement within the respective cylinders and connected to a drive shaft. Each cylinder is provided with a bronze insert covering the open top of each cylinder; each bronze insert includes an input and an output port. A center mounting plate is secured to the engine block having the cylinders positioned therein; the center mounting plate is secured to the outer surface of the motor block and positioned between the respective input ports and exhaust ports of the respective bronze inserts. Rotary valves are mounted for rotation with a drive shaft and include axially extending flanges mounted having close tolerances with respect to the bronze inserts. The axially extending flanges are provided with openings that are aligned with the intake port or exhaust port as the rotary valves rotate. When the slots or openings in the radially extending flanges are aligned with the respective port, fluids such as air may enter the respective cylinder axially thereof.

BRIEF DESCRIPTION OF THE DRAWINGS

The present invention may more readily be described by reference to the accompanying drawings in which.

DETAILED DESCRIPTION OF THE INVENTION

Figure 1:
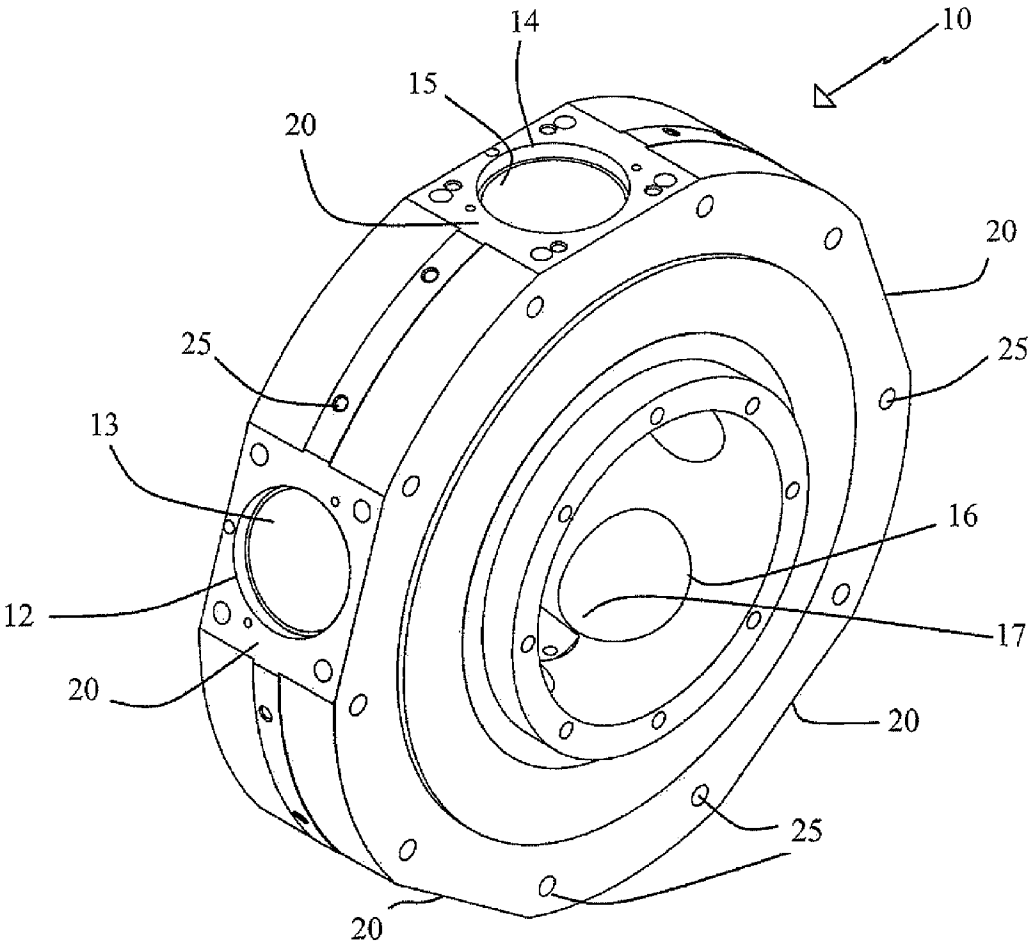
FIG. 1 is a perspective view of a cylinder block or motor housing utilized in the system of the present invention.
Figure 2:
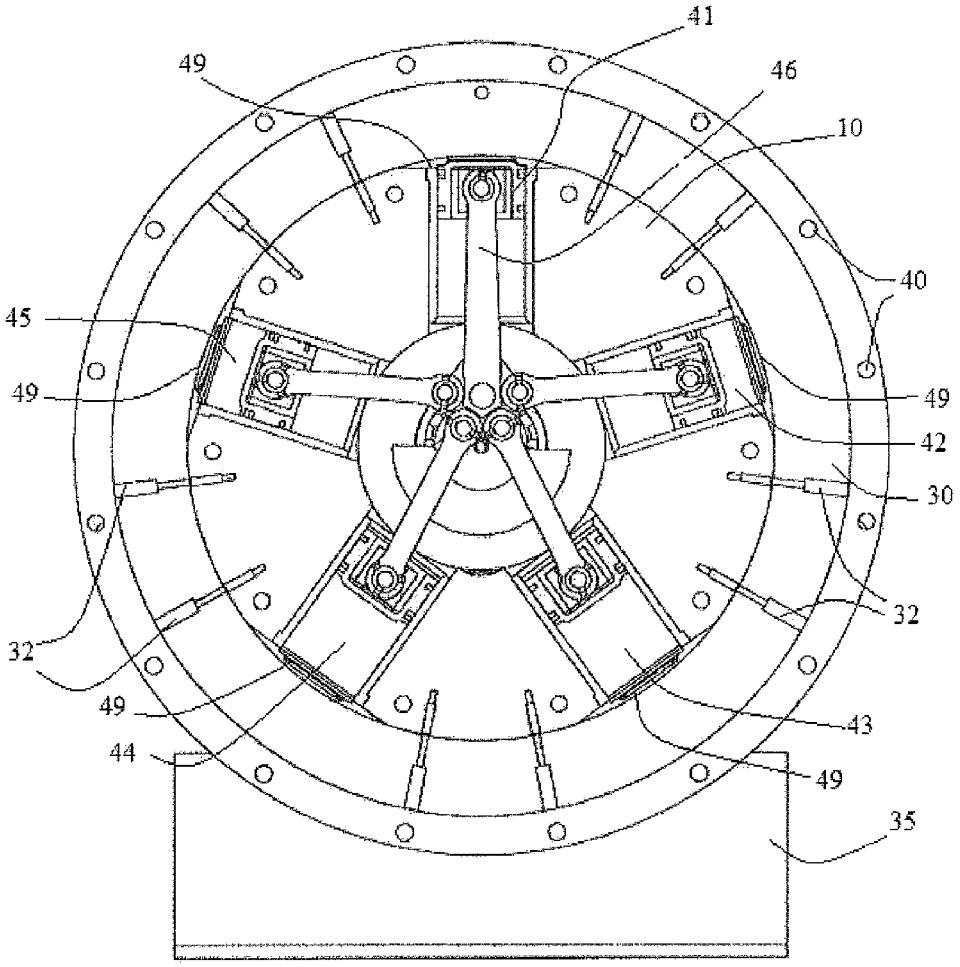
FIG. 2 is a sectional view of the motor housing of FIG. 1 including pistons and including a center mounting plate surrounding the housing of FIG. 1.

Referring to FIG. 1, a cylinder block or motor housing 10 is shown housing radially disposed cylinders 12, 14, 16; in the embodiment chosen for illustration, five cylinders are utilized. It will be understood that any number may be used to implement the present invention. In the embodiment chosen for illustration five radially disposed cylinders are evenly spaced at a radial angle of 72° with respect to each other. The cylinders include interiors that may include sleeves 13, 15 and 17, respectively, as shown; the cylinder block or motor housing may be constructed of any suitable material but is preferably made of a steel alloy; in the embodiment chosen for illustration in FIG. 1, the housing is generally circular in shape with the outer diameter provided with flats 20 for accepting inserts (to be described). The housing may also be provided with suitable tapped holes 25 to receive corresponding bolts to provide an assembled structure suitable for operation as an air pump/motor. A sectional view of an embodiment of an air pump/motor incorporating the teachings of the present invention is shown in FIG. 2. Referring to FIG. 2, it may be seen that the cylinder block 10 is secured to a center mounting plate 30 by a plurality of screw bolts 32. The center mounting plate 30 is secured to a motor stand 35 by bolts extending through flanges in the motor housing to clamp the center mounting plate 30 between the flanges (to be described). The pistons 41 through 45 are mounted for reciprocating movement in the cylinders and are shown in their respective cylinders at various positions in their corresponding piston strokes. Each of the pistons is secured to a corresponding piston rod that is pivotally connected at opposite ends thereof to the associated piston and to a crank shaft. There are various techniques for pivotally attaching piston rods to crank shafts in radial motors/pumps including the use of a master connecting rod such as connecting rod 46. These techniques are well known in the art and need not be described here.

The pistons in FIG. 2 are shown in corresponding positions within the respective cylinders. Inserts 49 are shown connected to the cylinder block 10 positioned over respective cylinders; the inserts 49 are secured to the flats 20 (FIG. 1) to thereby provide an essentially circular cross-section to the motor housing 10 that closely approximates the interior diameter of the center mounting plate 30.

Figure 3B:
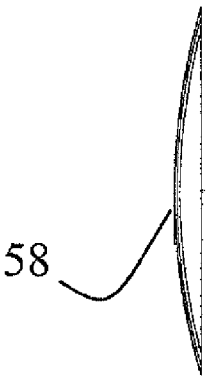
FIG. 3*b* is a side view of the bronze insert of FIG. 3*a*.
Figure 3A:
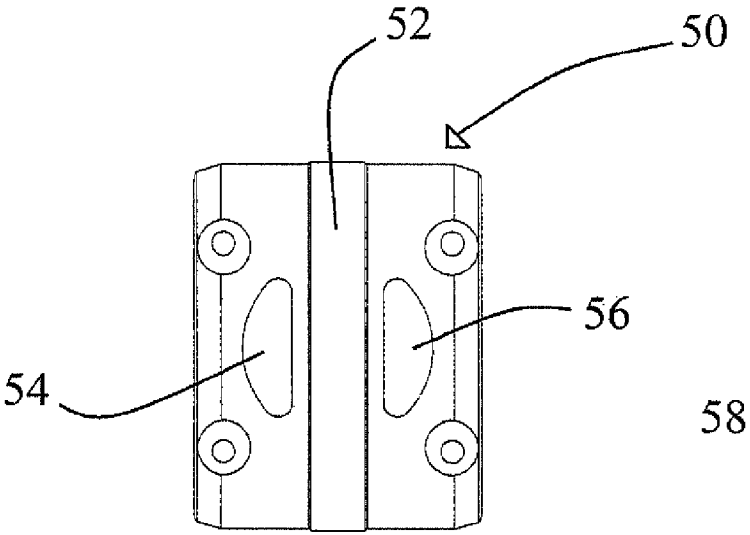
FIG. 3*a* is a plan view of a bronze insert utilized in the system of the present invention.
Figure 3C:
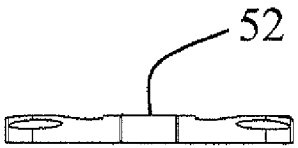
FIG. 3*c* is an end view of the bronze insert of FIG. 3*a*.

Referring to FIGS. 3*a*, 3*b* and 3*c*, the inserts 50 described above are shown in greater detail. The inserts 50 are fixed to the cylinder block by appropriate bolts and, when mounted on the cylinder block, cover the outer open ends of the respective cylinders. The inserts 50 are preferably made of bronze and are formed with a flattened center section forming a bridge 52 and a pair of openings 54 and 56 that, when mounted on the cylinder block, communicate with the interior of the corresponding cylinder. These openings 54 and 56 form intake and exhaust ports, respectively, to admit compressed air through the intake port into the cylinder (when used as a motor) and an exhaust port to permit the escape of lower pressure air. The openings 54 and 56 are separated axially of the motor block to form a bridge 52 therebetween. It may be noted that the radius of curvature of the outer surface 58 of the inserts may be slightly different than the outer diameter of the cylinder block to facilitate the provision of sealing clearances between the inserts and rotary valves (to be described). Alternatively, the cylinders could be machined in the cylinder block having enclosed cylinder top ends; in the latter alternative embodiment, intake ports and exhaust ports must be provided in the enclosed cylinder ends and separated axially of the motor to form a bridge and thus permit separation between the intake port and the exhaust port.

Figure 4A:
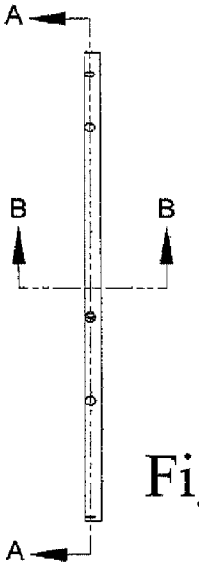
FIG. 4*a* is a side elevational view of the center mounting plate utilized in the system of the present invention.
Figure 4B:
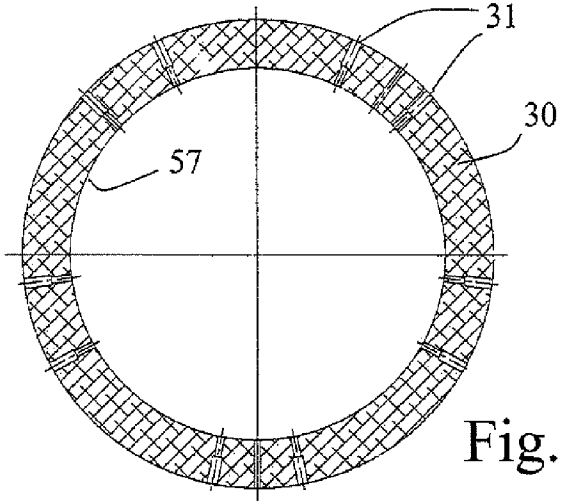
FIG. 4*b* is a sectional side view of the center mounting plate of FIG. 4*a* taken along line A-A.
Figure 4C:
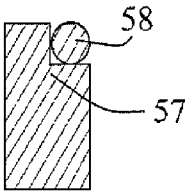
FIG. 4*c* is a sectional view of the center mounting plate of FIG. 4*a* taken along line B-B.

Referring to FIGS. 4*a*, 4*b* and 4*c*, the center mounting plate 30 is shown in greater detail where it may be seen that the plate is provided with suitable openings 31 for the admission of screw bolts to be secured to the cylinder block 10 (FIGS. 1 and 2) and is also provided with an O-ring groove 57 at its interior edge. This groove receives an appropriate O-ring 58 to form a sealing engagement with the respective inserts 50 and cylinder block 10. That is, the O-ring 58 of the center mounting plate 30 circumferentially contacts the cylinder block 10 and correspondingly sealingly engages the peripheral surface of the block 10 and is centrally disposed on each of the inserts in contact with the respective bridges to thereby separate the input ports 54 and exhaust ports 56 from each other.

Figure 5:
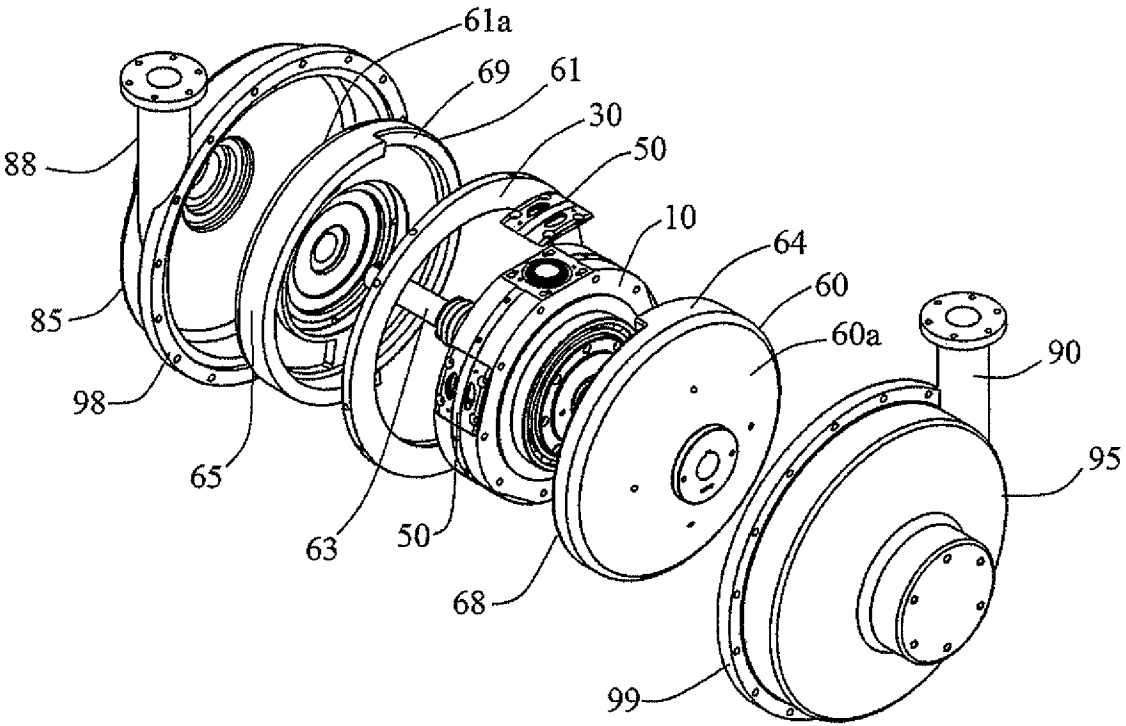
FIG. 5 is an exploded view of a pump/motor incorporating the teachings of the present invention showing the utilization of the cylinder block of FIG. 1, the bronze inserts of FIG. 3*a*-3*c* and the center mounting plate of FIGS. 4*a*-4*c*.

Referring to FIG. 5, an exploded view of a pump/motor incorporating the teachings of the present invention is shown. The cylinder block 10 is shown having the bronze inserts 50 exposed with one of the bronze inserts removed to reveal the open cylinder beneath the insert. It may be noted that the inserts each provide a pair of openings directly to the corresponding cylinder; one of the openings is an exhaust port and the other opening is an intake port. Intake and exhaust rotary valves 60 and 61, respectively, are each secured to the drive shaft 63 for rotation therewith while the center mounting plate 30 and cylinder block 10 remain stationary. Each of the rotary valves 60 and 61 is relatively cup-shaped; that is, each has a sloping radially disposed outer surface 60*a* and 61*a*, respectively, terminating in an annular axial flange 64 and 65, respectively. The axial flanges of the respective rotary valves are positioned with appropriate close radial proximity or clearances to the outer surfaces of the respective bronze inserts 50. Each of the rotary valves is provided with a circumferential slot 68 and 69, respectively, that provide communication between the cylinder input port or exhaust port and the exterior of the corresponding valve rotor. The circumferential length of the respective slots in the intake and exhaust rotor valves are provided with a predetermined length depending on the application of the system, rotational velocity of the drive shaft, working pressures, etc. Each of the rotary valves 60 and 61 is secured to the drive shaft 63 for rotation therewith while the center mounting plate 30 and cylinder block 10 remain stationary. Circumscribing radial flanges 98 and 99 of the exhaust and input housings 85 and 95, respectively, contact and clamp the center mounting plate 30 therebetween. When assembled, the housings 85 and 95 each provide an interior volume that communicates for example to a source of pressured fluid through pipe 90 or to an exhaust reservoir such as the atmosphere through pipe 88.

As indicated above, the intake and exhaust rotary valves 60 and 61 are provided with slots 68 and 69, respectively, that provide air or fluid communication with the cylinders through bronze inserts as described above. The circumferential dimension of the respective slots in the exhaust and intake rotary valves may be determined empirically and will depend on the ultimate use for the motor/pump. The intake and exhaust slots having predetermined circumferential lengths and are timed to provide maximum efficiency under the operating parameters for the particular use including such variables as gas pressure, rotational velocity of the drive shaft, and environmental considerations such as temperature and the like. Efficiency in the present design is maximized by directing air from the air supply and to the exhaust axially of the respective cylinders and directly from the supply of pressurized air (for a motor) into the corresponding cylinders without passage through intervening conduits or passageways. The ability to directly charge and exhaust the respective cylinders is a result of the rotary valve configuration wherein air is admitted to and exhausted from the respective cylinders axially with only the thickness of the corresponding inserts and ports between the supply and exhaust sources and the cylinders.

Figure 6C:
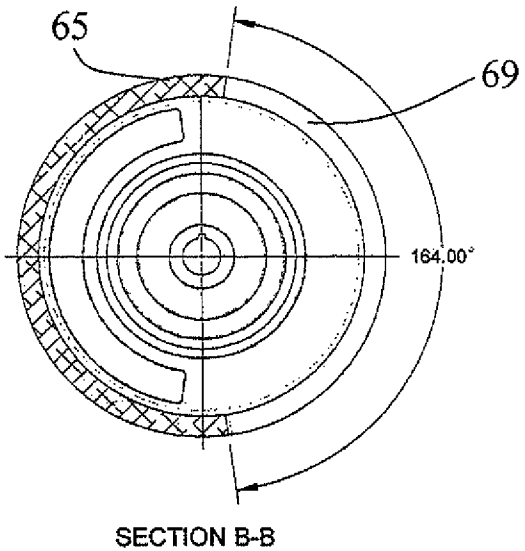
FIG. 6*c* is a side-elevational view, partly in section of FIG. 6*b* taken along line B-B.
Figure 6B:
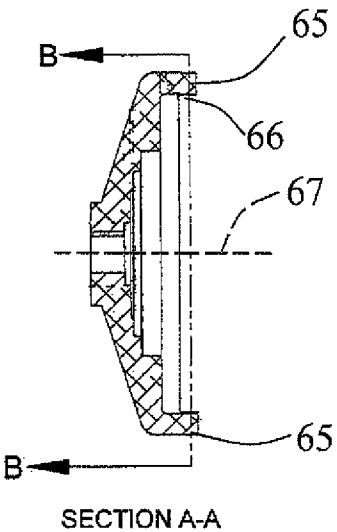
FIG. 6*b* is a cross-sectional view of FIG. 6*a* taken along line A-A.
Figure 6A:
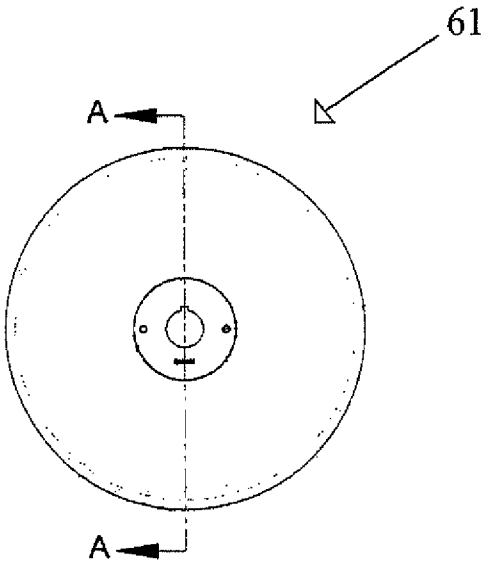
FIG. 6*a* is an elevational view of the exhaust rotary valve utilized in the system of the present invention.

Referring to FIGS. 6*a*, 6*b* and 6*c*, the exhaust rotary valve 61 is shown. It may be seen that the valve is cup-shaped having a flange 65 or lip that extends axially with respect to the motor housing and drive shaft. The internal diameter extending from the interior surface 66 of the flange to the axis of rotation 67 is close to, but slightly greater than, the diameter measured from the bronze inserts secured to the cylinder block to the axis of rotation 67. In the embodiment chosen for illustration, the flange 66 of the exhaust rotor of FIG. 6 incorporates a slot 69 extending for approximately 164° circumferentially of the rotor. Thus, when this slot is positioned over a corresponding exhaust port, the exhaust passage is clear to permit the exhaust of air from within the cylinder to the exhaust passageway externally of the motor or pump.

Figure 7C:
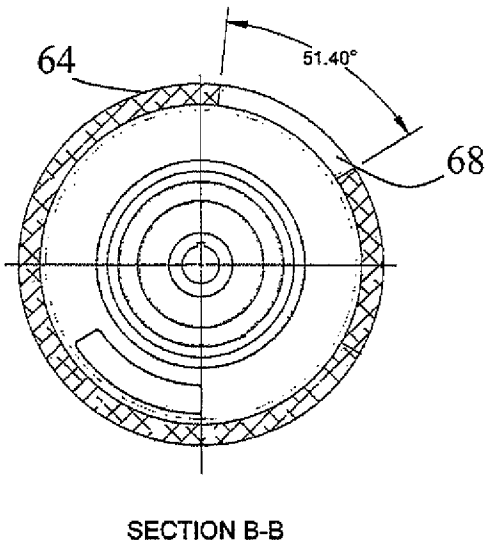
FIG. 7*c* is a sectional view of FIG. 7*b* taken along line B-B.
Figure 7B:
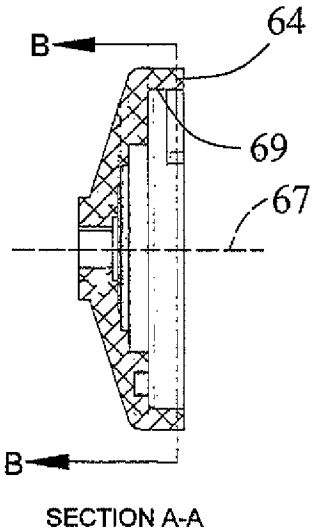
FIG. 7*b* is a cross-sectional view of FIG. 7*a* taken along line A-A.
Figure 7A:
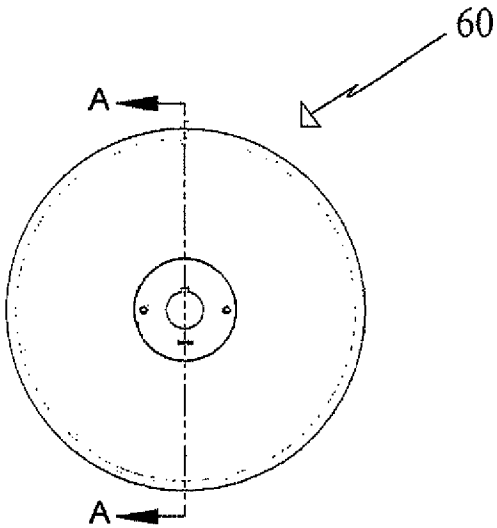
FIG. 7*a* is a front elevational view of an intake rotary valve incorporating the teachings of the present invention.

Referring to FIGS. 7*a*, 7*b* and 7*c*, an intake rotary valve 60 is shown wherein it may be seen that it is generally cup-shaped and incorporates a circumferential flange 64 that extends axially of the drive shaft of the motor/pump. The flange 64 has an inside diameter extending from the interior surface 69 to the axis of rotation 67 that is slightly greater than the outside diameter measured from the bronze inserts mounted on the cylinder block to the axis of rotation 67. Thus, with close tolerances and slight clearance, air passage to or from a corresponding cylinder is inhibited unless a machined slot provided in the flange is positioned over the intake port of a cylinder. In the embodiment chosen for illustration, the intake port machined in the flange of the rotary intake valve is shown to be 51.4°.

Thus, the intake and exhaust rotary valves provide a timed opening for the passage of air into and out of the cylinders; further, the airflow into and out of the cylinders is directed axially of the respective cylinders and radially with respect to the drive shaft. The preferred embodiment of the rotary valves are shown as cup-shaped wherein the rotary valve is mounted for rotation about the rotational axis of the drive shaft while the flanges of the respective rotary valves extend axially and are positioned in close tolerances to the surface of the intake and exhaust ports of the respective cylinders. Dimensional tolerances between the rotating rotary valves and the stationary ports may more easily be controlled through the utilization of bronze inserts as indicated above; however, it is possible that dual ports may be provided in the cylinder block adjacent the top of each cylinder. The center mounting plate contacts cylinder block and separates the input and exhaust ports permitting pressurized air or fluid to be applied at one side of the center mounting plate while permitting exhaust flow from the cylinder at the opposite side of the center mounting plate. The rotary valves described above are generally cup-shaped; however, the radially extending sloping surface of the rotary valves need not be continuous; that is, radially extending arms rotatable about the drive shaft axis and properly supporting the corresponding axially extending flanges would provide an alternative structure. The term "cup-shaped" is thus intended to include such alternate embodiments.

When outer housings are positioned on the pump/motor, the air entering a respective cylinder and exhausting from that respective cylinder travels inward or outward of the cylinder through the corresponding slot in the rotary valve from the space between the corresponding rotary valve and an outer housing (to be described).

Figure 8:
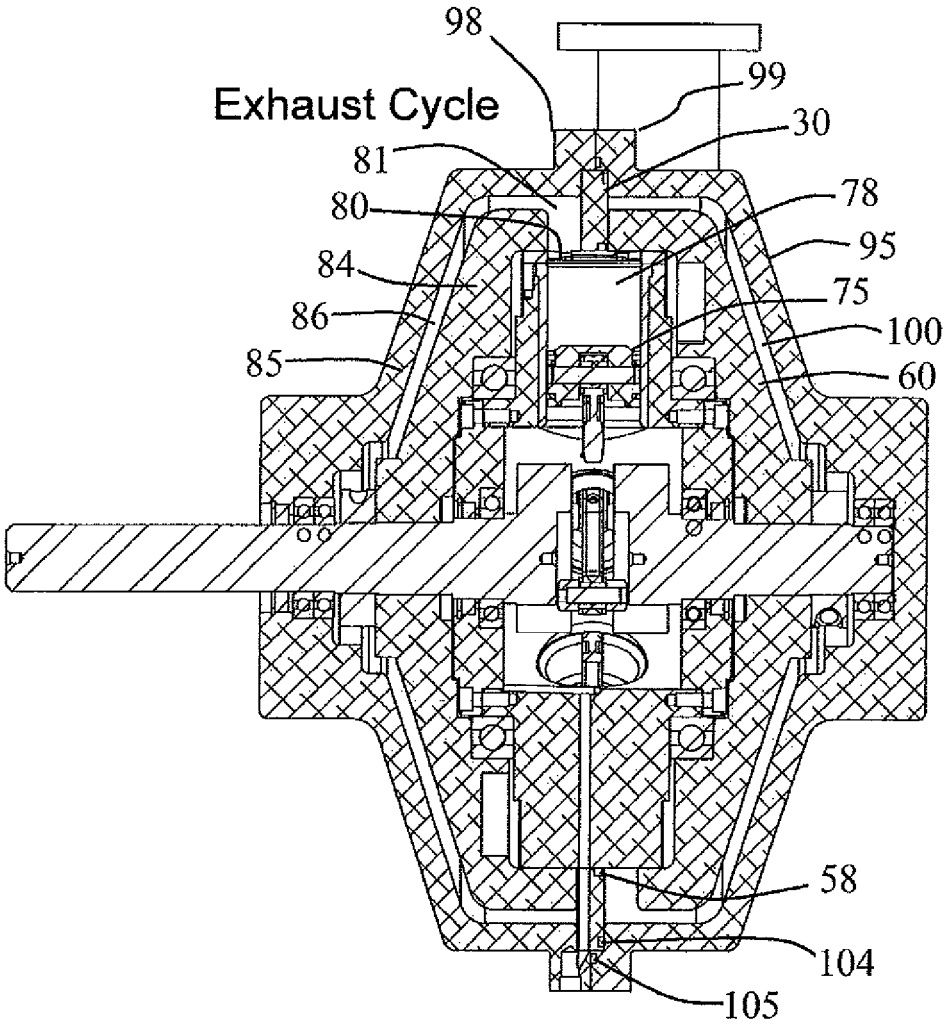
FIG. 8 is cross-sectional view of a pump/motor incorporating the teachings of the present invention showing the components therein in an exhaust cycle.

Referring to FIG. 8, a cross-sectional view of an air pump/motor incorporating the teachings of the present invention is shown in an exhaust cycle. The view of FIG. 8 shows the upper piston 75 at bottom dead center wherein it has just begun its exhaust stroke pushing air out of the cylinder 78 through the exhaust port 80 in the bronze insert, out of the slot 81 provided in the exhaust rotor 84 and into the space 86 between the exhaust rotor 84 and the exhaust housing 85. In the embodiment chosen for illustration in FIG. 8, the exhaust is directed to an exhaust stack or pipe 88 (FIG. 5) connected to or formed as a part of the outer housing 85 such as that shown in FIG. 5. It may be noted that the intake stack or pipe 90 (FIG. 5) communicates with the right as shown in FIG. 8 to fill the space 100 between the input rotary valve 60 and the housing 95.

It may be noted in FIG. 8 that the center mounting plate 30 is clamped between the radial flanges 98 and 99 of the housing halves and is provided with the circumferentially internal surface O-ring 58 (FIG. 4*c*) to isolate the respective input and exhaust ports of the corresponding cylinders. Further, the center mounting plate 30 is provided with sealing O-rings 104 and 105 at the clamping surface between the flanges of the housing. It thus may be seen that the input and exhaust passages are isolated with respect to each other.

Figure 9:
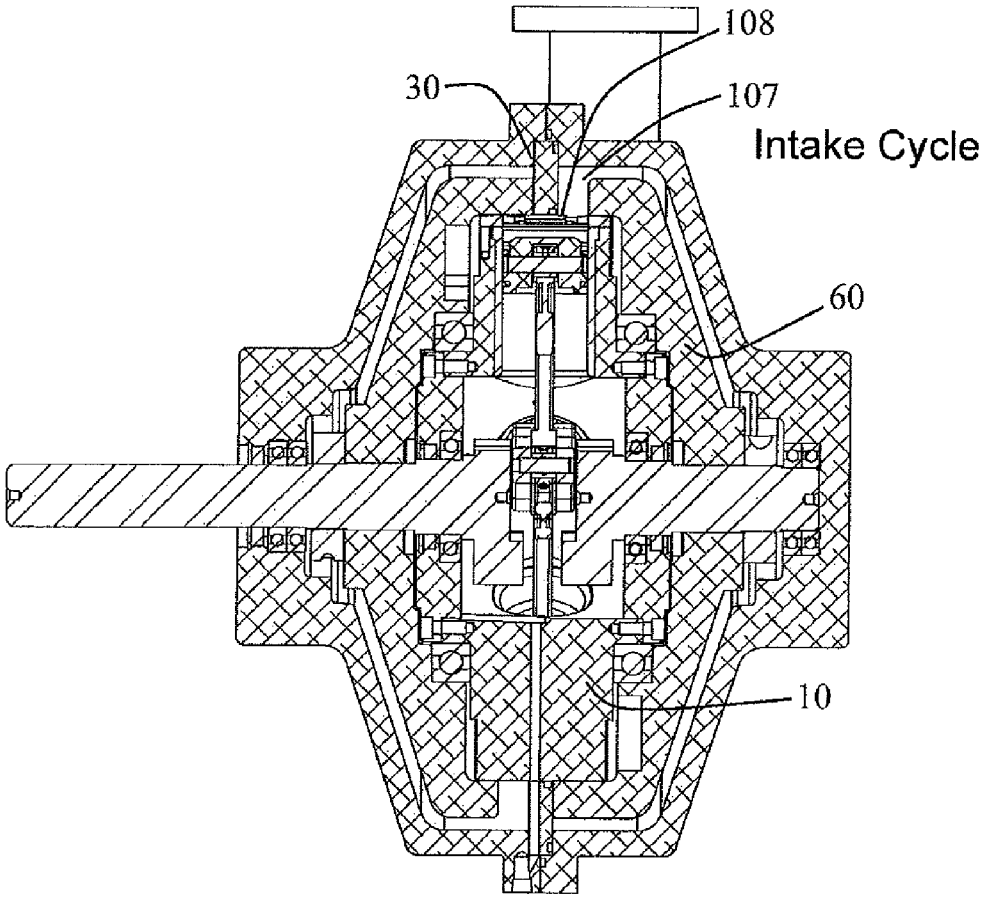
FIG. 9 is a cross-sectional view of a pump/motor incorporating the teachings of the present invention shown in an intake cycle.

Referring to FIG. 9, a cross-sectional view similar to that shown in FIG. 8 wherein the pump/motor of the present invention is shown during an intake cycle with the piston 75 in the upper cylinder 78 shown at top dead center wherein the intake slot 107 of the intake rotary valve 60 has become aligned with the intake port 108 of the corresponding insert to thus admit air directly into the cylinder. Again, it may be noted that the center mounting plate 30 is in sealing engagement with the cylinder block 10 and bronze inserts to prevent escape of intake air to the exhaust side of the center mounting plate.

Figure 10:
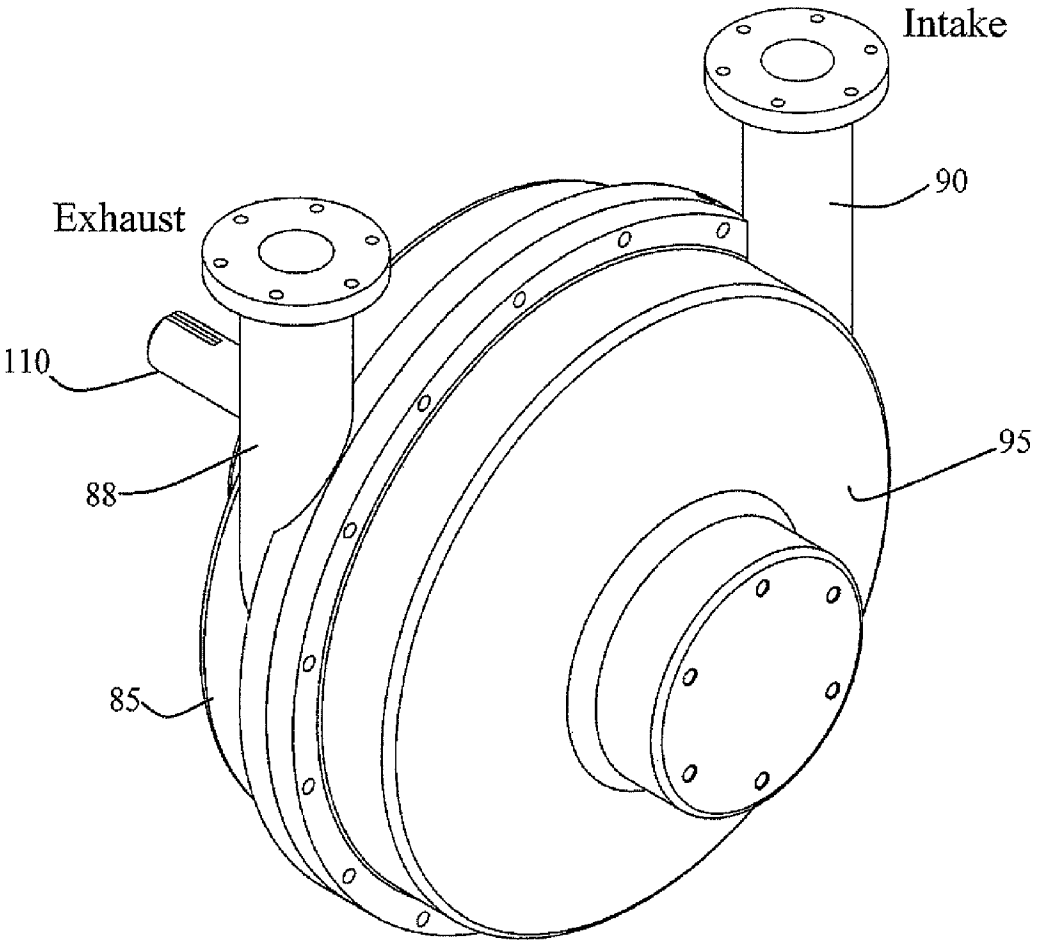
FIG. 10 is a perspective view of an assembled motor/pump constructed in accordance with the teachings of the present invention.

FIG. 10 is a perspective view of an assembled air motor/pump constructed in accordance with the teachings of the present invention. It may be seen that the exhaust and intake conduits or pipes 88 and 90 extend from the corresponding halves of the external housing. The radial flanges 98 and 99, respectively, of the external housing halves are shown secured to and clamping the center mounting plate as described above. The drive shaft 110 is shown extending from the assembly. Thus, pressurized air entering in the intake pipe 90 travels between the intake housing half and the intake rotary valve; as the rotary valve aligns ports in its axial flange with input ports of the inserts, the pressurized air is directed into the corresponding cylinder to force the piston radially inwardly to thus provide suitable force for rotation of the drive shaft. As the exhaust rotary valve aligns its exhaust slots with exhaust ports, spent air is directed into the space between the exhaust rotary valve and the exhaust housing. The exhaust air is ultimately directed to the exhaust conduit or pipe 88. It may be noted that the motor may be reversed by reversing the application of pressurized air; that is, applying pressurized air to the exhaust pipe effectively renders the exhaust pipe as an input to reverse the operation described above and reverse the rotation of the drive shaft 110. Fluids other than air may be utilized in the motor/pump of the present invention; the efficiencies of the motor/pump are equally applicable when other fluids are incorporated in the operation.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed:

1. A fluid motor/pump, the improvement comprising: (a) a motor block having a plurality of cylinders having interiors and arranged radially about a drive shaft; (b) a corresponding plurality of pistons, each piston mounted within a different one of said cylinders for reciprocating movement therein, and each piston connected by a piston rod to said drive shaft to drive, or be driven by, said drive shaft; (c) each cylinder having an enclosed top with an input port and an exhaust port extending through said top to provide fluid communication with the interior of said cylinder, said input port and exhaust port separated from each other axially along the motor block and drive shaft by a bridge formed therebetween; (d) a center mounting plate circumscribing and secured to said motor block and extending radially therefrom, said center mounting plate in sealing engagement with said motor block and in contact with each bridge to separate the input ports from the exhaust ports; (e) a rotary intake valve and a rotary exhaust valve each mounted for rotation with said drive shaft and each extending radially therefrom and terminating in an axially extending flange; the axially extending flange of the rotary intake valve extending axially over and in close radial proximity to the input ports of the cylinders; the axially extending flange of the rotary exhaust valve extending axially over and in close radial proximity to the exhaust ports of the cylinders; and (f) each of the axially extending flanges of the rotary valves including slots therein so that when the slots align with an input port or an exhaust port, a fluid passageway is presented to permit fluid to enter or exhaust from a cylinder longitudinally of the cylinder.

2. A fluid motor/pump, the improvement comprising: (a) a motor block having a plurality of cylinders having interiors and arranged radially about a drive shaft; (b) a corresponding plurality of pistons, each piston mounted within a different one of said cylinders for reciprocating movement therein, and each piston connected by a piston rod to said drive shaft to drive, or be driven by, said drive shaft; (c) each cylinder having an open top enclosed by an insert secured to the motor block, each insert having an input port and an exhaust port extending therethrough to provide fluid communication with the interior of the cylinder, said input port and exhaust port separated from each other axially along the motor block and drive shaft by a bridge formed therebetween; (d) a center mounting plate circumscribing and secured to said motor block and extending radially therefrom, said center mounting plate in sealing engagement with said motor block and in contact with each bridge to separate the input ports from the exhaust ports; (e) a rotary intake valve and a rotary exhaust valve each mounted for rotation with said drive shaft and each extending radially therefrom and terminating in an axially extending flange; the axially extending flange of the rotary intake valve extending axially over and in close radial proximity to the input of the cylinders; the axially extending flange of the rotary exhaust valve extending axially over and in close radial proximity to the exhaust ports of the cylinders; and (f) each of the flanges of the rotary valves including slots therein so that when the slots align with an input port or an exhaust port, a fluid passageway is presented to permit fluid to enter or exhaust from a cylinder longitudinally of the cylinder.

3. The fluid motor/pump of claim 2, wherein said inserts are made of bronze.

4. The fluid motor/pump of claim 3, wherein said rotary valves are cup-shaped.

5. A fluid motor/pump comprising: (a) a motor block having a plurality of cylinders having interiors and arranged radially about a drive shaft; (b) a corresponding plurality of pistons, each piston mounted within a different one of said cylinders for reciprocating movement therein, and each piston connected by a piston rod to said drive shaft to drive, or be driven by, said drive shaft; (c) each cylinder having an enclosed top with an input port and an exhaust port extending through said top to provide fluid communication with the interior of said cylinder, said input port and exhaust port separated from each other axially along the motor block and drive shaft by a bridge formed therebetween; (d) a center mounting plate circumscribing and secured to said motor block and extending radially therefrom, said center mounting plate in sealing engagement with said motor block and in contact with each bridge to separate the input ports from the exhaust ports; (e) a rotary intake valve and a rotary exhaust valve each mounted for rotation with said drive shaft and each extending radially therefrom and terminating in an axially extending flange; the axially extending flange of the rotary intake valve extending axially over and in close radial proximity to the input ports of the cylinders; the axially extending flange of the rotary exhaust valve extending axially over and in close radial proximity to the exhaust ports of the cylinders; (f) each of the flanges of the rotary valves including slots therein so that when the slots align with an input port or an exhaust port, a fluid passageway is presented to permit fluid to enter or exhaust from a cylinder longitudinally of the cylinder; (g) an intake housing and an exhaust housing enclosing said motor block and said rotary valves; (h) each housing having an interior volume and a radially extending housing flange; (i) said intake and exhaust housings joined at said housing flanges; and (j) said center mounting plate secured to at least one of said housings to separate the interior volume of the intake housing from the interior volume of the exhaust housing.

6. The fluid motor/pump of claim 5, wherein said center mounting plate is secured to said housings by clamping between the radially extending housing flanges of the intake housing and exhaust housing.

7. A fluid motor/pump comprising: (a) a motor block having a plurality of cylinders having interiors and arranged radially about a drive shaft; (b) a corresponding plurality of pistons, each piston mounted within a different one of said cylinders for reciprocating movement therein, and each piston connected by a piston rod to said drive shaft to drive, or be driven by, said drive shaft; (c) each cylinder having an open top enclosed by an insert secured to the motor block, each insert having an input port and an exhaust port extending therethrough to provide fluid communication with the interior of the cylinder, said input port and exhaust port separated from each other axially along the motor block and drive shaft by a bridge formed therebetween; (d) a center mounting plate circumscribing and secured to said motor block and extending radially therefrom, said center mounting plate in sealing engagement with said motor block and in contact with each bridge to separate the input ports from the exhaust ports; (e) a rotary intake valve and a rotary exhaust valve each mounted for rotation with said drive shaft and each extending radially therefrom and terminating in an axially extending flange; the axially extending flange of the rotary intake valve extending axially over and in close radial proximity to the input ports of the cylinders; the axially extending flange of the rotary exhaust valve extending axially over and in close radial proximity to the exhaust ports of the cylinders; (f) each of the flanges of the rotary valves including slots therein so that when the slots align with an input port or an exhaust port, a fluid passageway is presented to permit fluid to enter or exhaust from a cylinder longitudinally of the cylinder; (g) an intake housing and an exhaust housing, the housings, when coupled, enclosing said motor block and said rotary valves; (h) each housing having an interior volume formed within a circumscribing radially extended housing flange; (i) said intake housing and said exhaust housing being joined at the housing flanges; and (j) said center mounting plate secured to at least one of said intake housing and said exhaust housing to separate the interior volume of the intake housing from the interior volume of the exhaust housing.

8. The fluid/motor pump of claim 7, wherein said center mounting plate is secured to said housings by clamping between the radially extending housing flanges of the intake housing and exhaust housing.

* * * * *